United States Patent [19]

Yamagishi

[11] Patent Number: 4,831,603

[45] Date of Patent: May 16, 1989

[54] TIMING CONTROL DEVICE FOR DRIVING MECHANISM

[75] Inventor: Toshio Yamagishi, Nara, Japan

[73] Assignee: Sharp Kabushiki Kaisha, Osaka, Japan

[21] Appl. No.: 120,030

[22] Filed: Nov. 13, 1987

[30] Foreign Application Priority Data

Nov. 29, 1986 [JP] Japan ..... 61-285114

[51] Int. Cl.[4] ..... G04F 8/00; G04B 47/00

[52] U.S. Cl. ..... 368/9; 368/10; 368/113

[58] Field of Search ..... 368/1, 6, 9, 10, 107–113

[56] References Cited

U.S. PATENT DOCUMENTS 3,689,839 9/1972 Cother ..... 368/113

3,988,673 10/1976 Svensson et al. ..... 368/113

*Primary Examiner*—Vit W. Miska

*Attorney, Agent, or Firm*—Flehr, Hohbach, Test, Albritton & Herbert

[57] ABSTRACT

A timing control device for a driving mechanism including a clutch or a solenoid has a sensor which operates a fixed time interval after the mechanism is driven in response to a drive signal and a timer which measures the time interval between when this drive signal is given and when the sensor operates. This measured time interval is compared with a reference value and the timing of providing the drive signal is adjusted according to the result of this comparison.

4 Claims, 4 Drawing Sheets

TIMING CONTROL DEVICE FOR DRIVING MECHANISM

BACKGROUND OF THE INVENTION

This invention relates to a device for automatically controlling the timing of a driving mechanism such as a clutch or a solenoid in an apparatus such as a copier or a facsimile machine provided with a paper transporting mechanism.

With a driving mechanism such as a clutch or a solenoid, the time between receipt of a command and its actual execution is not zero and there is usually a delay of several milliseconds. For this reason, synchronism is lost due to such a delay in most apparatus with a transmission system using clutches and solenoids. In an electrophotographic copying machine, for example, a sheet of paper transported from a paper cassette by feed rollers is temporarily stopped at the position of timing rollers and is delivered therefrom to the photosensitive drum by the timing rollers which begin to rotate after a predetermined length of time but if the delay is large in the transmission of the clutch for driving the timing rollers, synchronism becomes unattainable and the front edge of the delivered sheet cannot come exactly to the designated position on the photosensitive drum.

Although previous attempts to overcome this problem included providing an adjusting means such as a timer for making a timing adjustment when the apparatus is assembled, the delays associated with clutches and solenoids are themselves known to change with time. In other words, even if synchronism is established at the time of the assembly of the apparatus, it is gradually lost with time and adjustments are required periodically.

SUMMARY OF THE INVENTION

It is therefore an object of the present invention to provide a timing control device for a driving mechanism capable of automatically adjusting the timing of the mechanism such that its synchronism relationship can be maintained by detecting the delay in its transmission although it may change with time.

The above and other objects of the present invention are achieved by providing a device comprising a driving element such as a clutch or a solenoid, a sensor which operates a predetermined length of time after this driving element is driven, a timer for measuring the time interval between the first point in time when a driving signal is delivered to the driving element and the second point in time when the sensor operates, and a means for comparing the measurement by the timer with a reference value to change, according to the result of this comparison, the timing of signals to the driving element.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
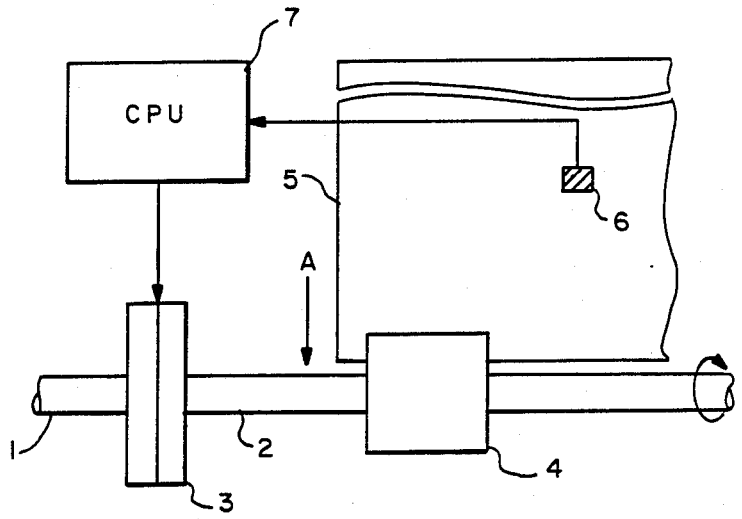
FIGS. 1-3 are drawings for explaining a timing control device embodying the present invention, FIG. 1 being a schematic drawing showing the structure of its paper transporting passageway, FIG. 2 being its timing flow chart and FIG. 3 being a flow chart of the operation of its control system.

As an example of the present invention, FIG. 1 shows a timing control device for controlling the timing of a clutch 3 between a drive shaft 1 and a rotary axis 2 to which a roller 4 for transporting sheets of paper is affixed. Arrow A indicates the direction in which this roller 4 transports a sheet 5 in contact therewith and numeral 6 indicates a sensor for transmitting a detection signal to a CPU 7 when it detects the rear edge of this paper 5. If sheets of a similar length are transported, this sensor 6 would always operate at the same time after the clutch 3 is driven. The CPU 7 is adapted, as will be explained in detail below, to receive detection signals from the sensor 6 and to thereby adjust the timing of the clutch 3.

Figure 2:
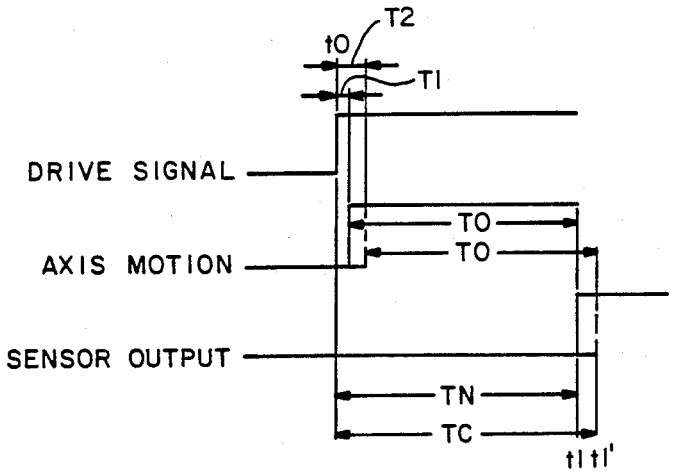

FIG. 2 shows the relationship among the drive signals transmitted from the CPU 7 to the clutch 3, the motion of the rotary axis 2 (or the timing of the clutch 3) and the output signal from the sensor 6. In FIG. 2, $t_0$ indicates the time at which the drive signal from the CPU 7 rises and the clutch 3 causes the rotary axis 2 to rotate with a delay of $T_1$. The roller 4 transports the sheet 5 from this time on in the direction of the Arrow A and the output signal from the sensor 6 rises after a time interval of $T_0$ (or at time $t_1$). The time interval $T_0$ is determined by the length of the sheet 5.

Let us now suppose that the delay by the clutch 3 has changed from the initial value of $T_1$ to a larger value $T_2$. Since the aforementioned time interval $T_0$ (between when the roller 4 begins to move the sheet 5 and when its rear edge is detected by the sensor 6) is constant, the interval $T_C$ between $t_0$ and $t'_1$ (when the sensor 6 detects the rear edge of the sheet 5 after the aforementioned change has taken place), is greater than $t_1-t_0=T_N$ (referred to as the reference value above). In other words, the change in the delay by the clutch 3 is given by $T_C-T_N$ and the CPU 7 accordingly adjusts the timing of providing a drive signal to the clutch 3. As a result, the timing of starting the motion of the rotary axis 2 is made to remain the same as before and hence sheets are thereafter transported with the same timing as initially set. A fixed reference value may be used as $T_N$ in the above operation. Alternatively, the value of an earlier interval (such as the immediately preceding interval) may be used as $T_N$ for the adjustment by the CPU 7.

Figure 3:
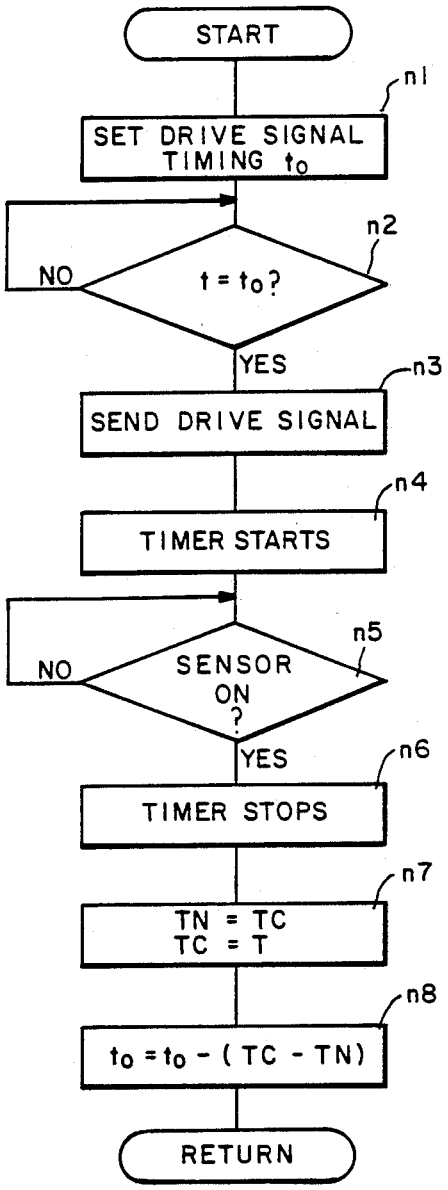

The operation of the CPU 7 for effecting the aforementioned control is explained next by way of the flow chart of FIG. 3. After the timing $t_0$ of supplying a drive signal to the clutch 3 is set (n1), the system waits until the set time $t_0$ is reached (n2) and transmits a drive signal at $t=t_0$(n3). A timer (not shown) is then started (n4) and when the sensor 6 detects the edge of a sheet and outputs a detection signal (n5), it is stopped (n6), the value (T) measured by the timer is set as the new value of $T_C$ and the earlier value of $T_C$ is set as the new value of $T_N$(n7). Thereafter, the timing $t_0$ for drive signals is changed from $t_0$ to $t_0-(T_C-T_N)$ as explained above (n8). By repeating this process, any change in the delay in the action of the clutch 3 can be reflected in the control of the subsequent delivery of paper such that the required synchronism in the delivery of paper can always be maintained.

Figure 4:
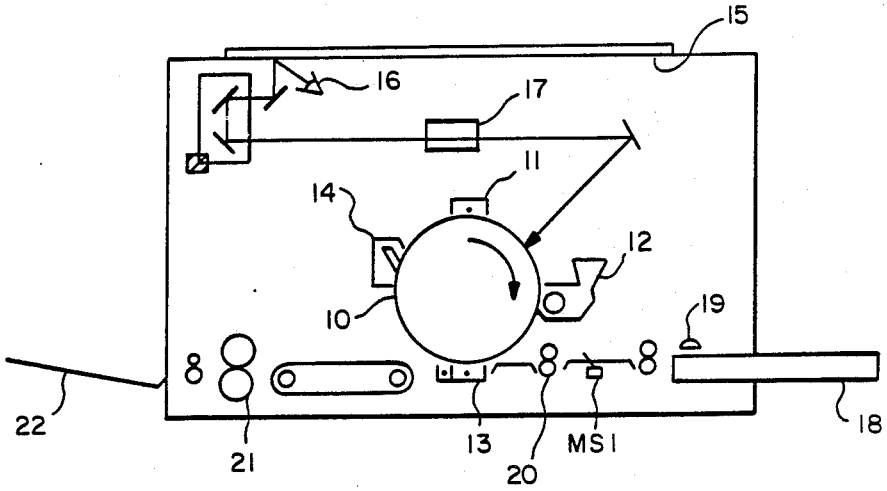
FIG. 4 is a schematic sectional view of an electrophotographic copier incorporating a timing control device embodying the present invention to show its structure.
Figure 5:
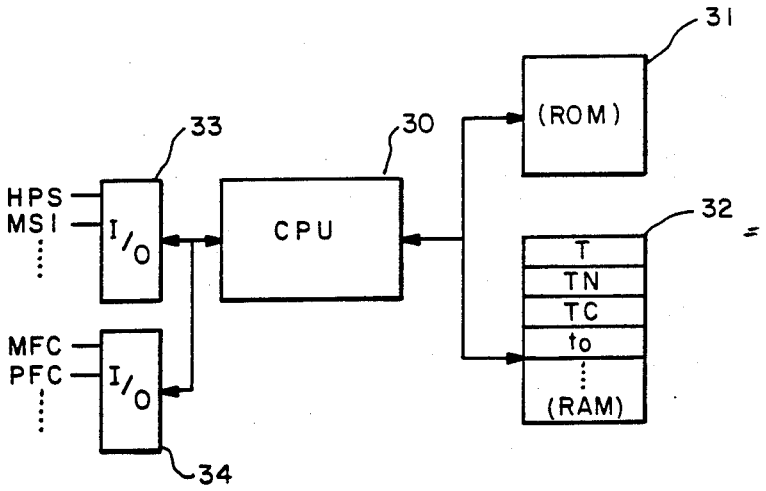
FIG. 5 is a schematic block diagram of the control system of the copier of FIG. 4, and FIGS. 6A and 6B are flow charts of the principal operations of the CPU of FIG. 5.

With reference next to FIG. 4, which schematically shows the structure of an electrophotographic copier incorporating a timing control device of the present invention, a photosensitive drum 10 is disposed approximately at the center of its housing, surrounded by a main charger 11, a developing unit 12, a transfer and paper-removing charger 13 and a cleaner unit 14. An original document to be processed (copied) is placed on a document table 15 and is scanned by the movement of a light source 16. The reflected light from the document is made incident on the photosensitive drum 10 by means of a lens 17 and a plurality of reflective mirrors. Sheets of transfer paper are placed in a paper cassette 18 at a lower right-hand part of the housing and are sequentially taken out of it and delivered to the position of timing rollers 20 by the operation of a paper feed roller 19. The transported sheet is temporarily stopped there and when the front edge of an image formed on the photo sensitive drum 10 has reached a pre-defined position, the timing roller 20 is activated and the image on the drum 10 is transferred to the sheet. Thereafter, the sheet is transported to a fixing section where the transferred image is fixed by fixing rollers 21 and then discharged onto a discharge tray 22.

For a copier structured as explained above, a timing control device of the present invention is used for adjusting the timing of driving the timing rollers 20. The driving rotary axis of the timing rollers 20 is connected to a drive shaft (not shown in FIG. 4) through a clutch (not shown in FIG. 4) of the type shown in FIG. 1 and a CPU (not shown in FIG. 4) controls the driving of this clutch. A sensor MS1 for detecting the rear edge of a sheet is also provided between the timing rollers 20 and the feed roller 19. As explained above, the CPU is programmed to set the timing of the next delivery of a sheet by the timing rollers 20 by receiving a detection signal from this sensor MS1, indicating that the rear edge of the sheet being transported from the cassette 18 has been detected.

In the control system of the copier described above by way of FIG. 4, there is a CPU 30 connected to a read-only memory 31 storing the problems to be performed, a random-access memory 32 to which the timer and work areas are assigned and I/O interfaces 33 and 34. Connected to the I/O interface 33 are various sensors including a home position sensor for detecting the home position of the optical unit and the aforementioned sensor MS1 for detecting the rear end of a sheet transported from the cassette 18. Connected to the other I/O interface 34 are driving means such as solenoids and clutches including a main feed clutch for driving the optical unit, and a paper feed clutch for driving timing rollers 20. Assigned to the RAM 32 are the aforementioned timer and areas for storing the preceding timer reading $T_N$, the current timer reading $T_C$ and the current timing for the drive signal to the paper feed clutch.

Figure 6A:
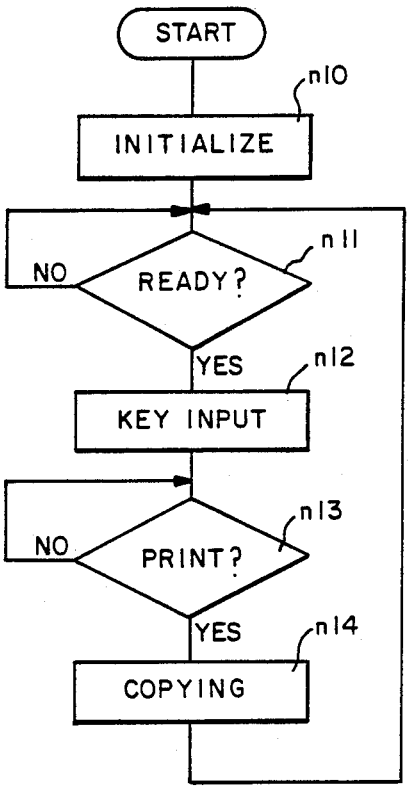
Figure 6B:
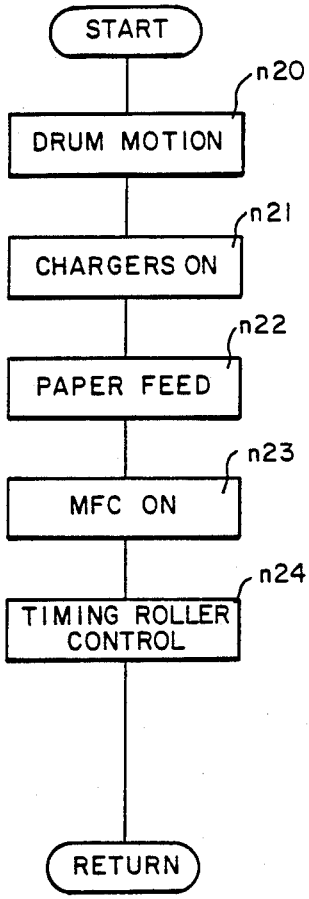

With reference to the flow charts of FIGS. 6A and 6B, the CPU 30 carries out initialization processes (n10) when power is initially switched on and various data such as the number of copies to be produced and magnification are accepted from a keyboard (n12) after a ready condition is established (n11). If a print switch is pressed thereafter (n13), the copier begins a cycle of copying operations, driving the photosensitive drum 10 (n20), activating the chargers such as the main charger 11 (n21) and delivering paper one sheet at a time from the cassette 18 to the position of the timing rollers 20 (n22). The main feed clutch is then switched on (n23) to drive the optical unit and after a predefined time, the CPU 30 begins to control the driving of the timing rollers 20 (N24) as explained above by way of FIG. 3.

The foregoing description of a preferred embodiment of the invention has been presented for purposes of illustration and description. It is not intended to be exhaustive or to limit the invention to the precise form disclosed. For example, it need not be the paper feed clutch for which the timing of the driving mechanism is controlled by a device of the present invention. It is to be understood that a timing control device of the present invention is applicable equally effectively to the main feed clutch. Although the timer reading in the previous cycle was used as the reference value $T_N$ in the example described above by way of FIG. 3, furthermore, a constant reference value may be adopted as mentioned above. In summary, a timer is provided according to the present invention to measure the time interval identified above by $T_C$ and to determine the delay of a driving mechanism by comparing this time interval with an appropriately selected reference value $T_N$. Any modifications and variations of the above disclosure that may be apparent to a person skilled in the art are intended to be included within the scope of this invention.

What is claimed is:

1. A timing control device for a driving mechanism comprising a driving means such as a clutch or a solenoid;

a sensor which operates a fixed time interval after said driving means is driven in response to a drive signal;

a timer which measures the time interval between a first point in time at which said drive signal is given to said driving means and a second point in time at which said sensor operates; and control means for evaluating the difference between said measured time interval by said timer and a reference value and adjusting the time at which said drive signal is given next according to said difference.

2. The device of claim 1 wherein said reference value is a predetermined constant value.

3. The device of claim 1 wherein said measured time intervals from the preceding cycle of operation of said driving mechanism is used as said reference value.

4. The device of claim 1 wherein said control means comprises a CPU connected to memory means storing programs therefor.

* * * * *